United States Patent [19]

Zetting

[11] 3,946,377

[45] Mar. 23, 1976

[54] METHOD AND APPARATUS TO MONITOR CONDUCTION OF SONIC WAVES IN AN ACOUSTICALLY CONDUCTIVE MEDIUM

[75] Inventor: Alois Zetting, Herrliberg, Switzerland

[73] Assignee: Cerberus AG, Mannedorf, Switzerland

[22] Filed: June 21, 1974

[21] Appl. No.: 481,818

[30] Foreign Application Priority Data

July 10, 1973 Switzerland ..... 10024/73

[52] U.S. Cl. ..... 340/274 R; 340/261; 73/67.5 R; 73/67.7

[51] Int. Cl.[2] ..... G08B 13/08

[58] Field of Search ..... 340/15, 170, 274, 258 A, 340/248 A; 73/67.5 R, 67.6, 67.7; 343/261

[56] References Cited

UNITED STATES PATENTS

| | | | |
|---|---|---|---|
| 2,987,713 | 6/1961 | Bagno | 340/258 A |
| 3,050,989 | 8/1962 | Henry | 73/67.7 |
| 3,111,657 | 11/1963 | Bagno | 340/258 A |
| 3,712,119 | 1/1973 | Cross et al. | 73/67.7 |
| 3,801,977 | 4/1974 | Cotter | 340/258 A |
| 3,889,250 | 6/1975 | Solomon | 340/274 |

*Primary Examiner*—Maynard R. Wilbur
*Assistant Examiner*—T. M. Blum
*Attorney, Agent, or Firm*—Flynn and Frishauf

[57] ABSTRACT

To detect breakage of glass panes, panels of display cases, or movement in a room, ultrasonic waves, preferably in the order of from 120 kHz to 180 kHz, are transmitted to the sonically conductive medium (glass panes, plastic sheets, or into the air of the room), and the waves are received in a receiver. The time shift of the received waves at the receiver location, with respect to the transmitted waves is determined, and if this time shift changes beyond a predetermined limit, an alarm signal is generated. Preferably, the ultrasonic signals are frequency modulated, for example by shifting the generated waves by a predetermined frequency shift, and determining the temporal change, or delay of the frequency shift, as received, with respect to the time of frequency shift at the transmitter. To prevent the effect of drift, the rate of change of received with respect to transmitted frequency shift can be used to generate the alarm.

30 Claims, 8 Drawing Figures

METHOD AND APPARATUS TO MONITOR CONDUCTION OF SONIC WAVES IN AN ACOUSTICALLY CONDUCTIVE MEDIUM

The present invention relates to a method and apparatus to carry out the method to monitor or supervise the conduction of sonic waves in a medium which is capable of conducting acoustic or sonic waves, and more particularly to an alarm system which provides an alarm when predetermined characteristics of received signals deviate from the transmitted signals by an excessive value.

It has previously been proposed to use sonic-type waves, typically ultrasonic waves, as a detector to detect disturbances of protective surfaces, such as glass panes, display panes, display cases, safes, or safety deposit vaults. The medium which conducts the ultrasonic waves usually was the wall medium itself, that is, a glass pane, plastic panel, a metal wall of the safe, or the like. An ultrasonic transducer is located on the respective wall or panel and is generating acoustic waves, preferably in the ultrasonic range, which are applied to the panel, wall or the like. A wave transducer of the receiver type is then located at a different point on the wall, panel or the like, which receives the waves transmitted by the transmitter through the specific medium, that is, the wall or the like. An electrical alarm system is connected to the receiver transducer to control an appropriate signalling system.

It has also been proposed to monitor movement in a room by flooding a room with ultrasonic waves, receiving the waves, and deriving a supervisory, or monitor signal if the received wave does not meet certain predetermined criteria.

In one arrangement (see German Disclosure Document DT-OS 1,913,161), spaces or objects therein are protected by transmitting within a medium, e.g. a metallic object, sonic waves in the ultrasonic range, and measuring the received waves. Upon attenuation of the received amplitude, an alarm is generated. The alarm generation thus results not only if the object is destroyed, or a space blocked, but also when the object is already touched. If the structure to be supervised is a display window, touching of the display window, for example by a curious onlooker would trigger the alarm. Thus, frequent false alarms would be triggered even though no interference with the display panel or window itself was intended.

In another system (see DT-OS 2,056,015), an article to be protected, for example a glass panel, is brought into resonant oscillations. The oscillations are received by a suitable oscillation transducer. A change in amplitude, again, provides a triggering alarm signal. This arrangement, also, has the disadvantage that a change in amplitude may result not only from damage to the panel itself, but already upon touching of the panel. In another system, use is made of change in resonant frequency upon damage to a glass panel, to trigger an alarm. Such a system requires a complicated feedback circuit in order to re-adjust the oscillating frequency if the resonant frequency, to which the panel is resonant, is not constant. Any attentuation of amplitude in such a system also interferes with effective measurement.

It is an object of the present invention to provide a method, and an apparatus which are suitable to supervise a medium and in which false alarms are largely avoided, but which, nevertheless, reliably provide an alarm system when the medium is disturbed.

SUBJECT MATTER OF THE PRESENT INVENTION

Briefly, the temporal shift of received sonic-type frequency modulated signals, with respect to transmitted signals is determined; if the temporal shift changes by a predetermined limit, an alarm signal is generated.

The system and method according to the present invention thus do not rely on change in amplitude, which necessarily occurs when a protected object is damaged or destroyed, but which may already occur when the object is merely touched. Rather, the system and method of the present invention utilize the characteristic of time shift, or time delay of the modulation of the received signal with respect to the signal transmitted into the medium. If the signal is a sinusoidal oscillation, or is a periodically pulsed oscillation, then the time shift corresponds to the phase difference between the received signal and the transmitted undulations, or pulses. If the sonic vibration transmission characteristics of the medium change for example if a glass panel is damaged, cracked, or destroyed, then the path of sonic vibration between receiver and transmitter changes, and thus the transit time of the waves within the medium changes, thus resulting in a phase shift. Change in the amplitude of oscillation does not, however, influence the phase shift.

The present invention is not limited to protection of plane, or panel-like objects such as glass panes, walls, or the like, but may equally be applied to protect or supervise any desired sonically conductive medium; it may, for example, be used to protect articles in display cases, displayed in shops, or museums; to supervise enclosed spaces, such as rooms or the like; to supervise fencing or other enclosures, in which the object itself to be protected, the fencing material, or the air within the room may function as the sonically conductive medium. Any changes in the sonic conduction in the room change the distribution of the field of the sonic waves in the room, the panel, the enclosure, or the like.

In accordance with a feature of the invention, the signal is a frequency modulated signal which is modulated on a carrier. If the medium has dispersion, for example if the carrier frequency is selected to fall within the region of the resonance frequencies of the medium, the group velocity, or cluster velocity phenomena (known from wave analysis) may result. The present invention makes use of this phenomenon. "Group velocity" is defined (McGraw-Hill Dictionary of Scientific and Technical Terms) as the velocity of an envelope of a group of interfering waves having slightly different frequencies and phase velocities. This phenomenon may be explained, briefly, in that a modulated signal is subjected to an additional time delay, with respect to a pure carrier signal, which additional time delay may be much greater — by a substantial factor — than the phase shift or phase delay itself of a nonmodulated carrier wave which propagates between a transmitter and a receiver in the medium.

Minor changes in the medium, such as a minor damage to a glass panel at any random position already changes the resonance positions to such an extent that the group velocity changes in the modulation signals will be clearly apparent. This damage to a glass pane may be at any position and need not be located between the transmitter and the receiver. The group velocity changes of a modulated signal may be substantially higher than the phase shifts of pure sinusoidal oscillations. Modulated signals have the substantial advantage that the change between received and transmitted signals is substantial even if the disturbance to the medium is at a location not between the path of receiver and transmitter, and may be at any random location. This permits great latitude in the physical location of the transmitter and receiver with respect to the medium to be supervised or protected, without interfering with the effectiveness of the supervising capability of the system. When using modulated signals, it is then possible to supervise a region or zone which is not physically located between the transmitter transducer and the receiver transducer; rather, the entire medium which is subjected to the oscillations is being supervised, that is, the entire surrounding which has an effect on the received signal, with respect to the transmitted signal. If, for example, a glass panel is to be supervised, it is possible to locate both the transmitter transducer and the receiver transducer at the same side of the glass panel. The distance between the transducers, themselves, is not critical. This substantially simplifies installation of the transducers. The time shift of the modulated signal is substantial even if the glass panel is damaged at any random position, so that the alarm circuit, which senses the time shift, can be simple and set for a comparatively high threshold value, to provide, reliably, an alarm signal while rejecting false alarms or errors which may arise due to amplitude attenuation, resulting for example merely by touching the glass panel.

A particularly good effect is obtained if the frequency range is so selected that the resonance frequencies of the sonically conductive objects are narrow. In glass panels, walls of vaults or safes, or the like, this range will generally be above 100 kHz. The frequency range is preferably so selected that it covers many closely adjacent resonance frequencies, so that an exact adjustment to a specific resonance frequency is not necessary, thus avoiding adjustment difficulties in connection with previously known systems; it is simple to properly select the frequency ranges for the specific objects.

The frequency of the sonic-type wave transmitted into the body is preferably so selected that the wave length within the object becomes so small that it is below the spacial extent of the damage to be expected. If this frequency, then, is high enough, already small regions of damage, which are in the order of the wave length of the sonic energy transmitted, will result in substantial group velocity delay shifts or changes. Generally, wave lengths of a few centimeters are suitable. Thus, ultrasonic frequencies of over 100 kHz are preferred.

The influence of changes in amplitude can be practically entirely avoided by frequency modulating a carrier wave; thus, the monitor or protective system becomes entirely independent of mere touching of the protected object. A particularly suitable way of frequency modulation is mere frequency shift between two fixed frequency values. Time shift can readily be determined under such conditions, that is, the group velocity shift of the frequency jumps at the receiver can readily be analyzed with respect to similar frequency jumps in the transmitter. A reliable alarm signal can then be provided.

The invention will be described by way of example with reference to the accompanying drawings, wherein.

FIG. 3, collectively, is a series of graphs, with respect to time, in which

Figure 3A:
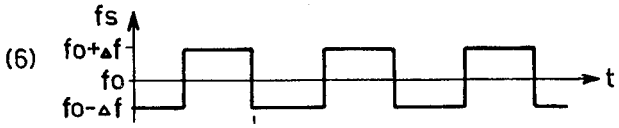
Figure 3B:
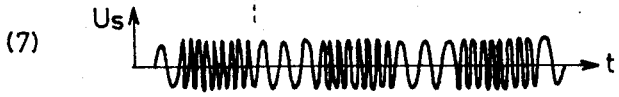
Figure 3C:
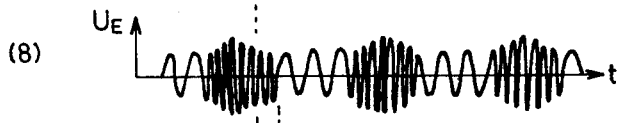

FIG. 3*a* is a graph of the frequency modulating signal;

FIG. 3*b* is the frequency modulated signal applied by the transmitter;

FIG. 3*c* is the signal as received by the receiver, to the same time scale as FIG. 3*a* and FIG. 3*b;*

Figure 3D:
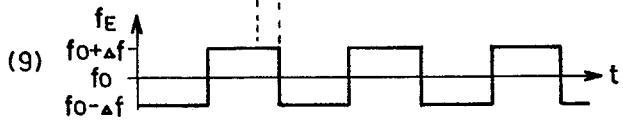
Figure 3E:
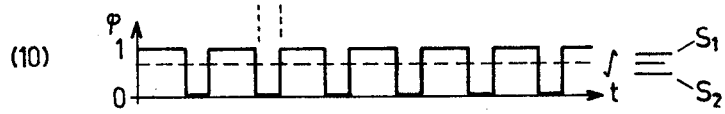

FIG. 3*d* is the recovered modulating envelope of the received signal;

FIG. 3*e* is the difference signal between FIGS. 3*a* and 3*d;* and

Figure 4:
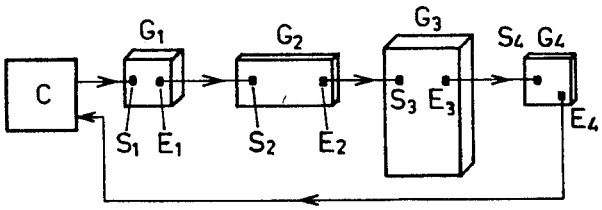

FIG. 4 illustrates application of the system to a plurality of supervised objects $G_1$, $G_2$, $G_3$, $G_4$.

The medium to be monitored, for example a glass pane 1 of a display window, a display case, or the like, has a transmitter transducer 2 applied thereto which, preferably by means of a piezo-electric element transduces electrical energy into ultrasonic vibrations in glass pane 1. A receiving transducer 3 is secured to the glass pane which, preferably, also is a piezo-electric vibration transducer. Transmitting transducer 2 and receiving transducer 3 are both connected to a generator, control, and evaluation circuit 4 which controls an alarm device 5.

Figure 2:
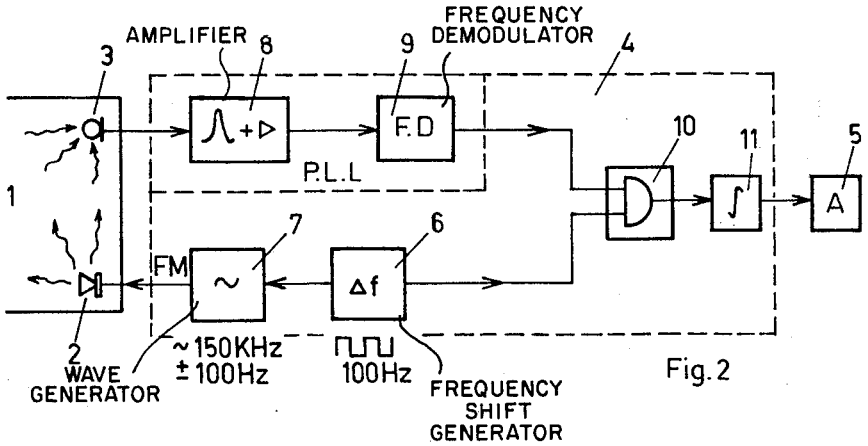
FIG. 2 is a more detailed schematic illustration of the system of FIG. 1.

FIG. 2, illustrates the generator and control apparatus 4 in greater detail. Transducer 2 is supplied with ultrasonic energy from a generator 7. If the element to be supervised is a glass pane, for example a store display window, a frequency in the range of from 120 Hz to 180 kHz is suitable. The frequency generated by generator 7 is varied, periodically, by a small value, for example ± 100 Hz, so that the generator 7 will provide frequency modulated wave energy to the transmitter transducer 2. The modulation signal is a square wave — see FIG. 3*a*. The oscillation, with respect to time, applied by transmitter 2 to the glass panel or glass pane 1 is illustrated, in schematic form, in FIG. 3*b*.

Vibrations are induced in the glass panel 1 by the transducer 2. These vibrations, within the panel, will result in a predetermined vibration pattern, having nodes and antinodes, corresponding to the nearest resonance frequency of the respective transmission path in the medium between transmitter and receiver, that is, in the path transmitter 2 - medium receiver 3. In order to provide for sufficient amplitude of oscillation, the carrier frequency should be in such a frequency range in which many closely adjacent resonance frequencies in the panel 1 occur, corresponding to different oscillation patterns. Experiments have shown that the usual frequencies, in glass display window panels of the most usual sizes is in the order of from 120 Hz to 180 kHz.

The receiving transducer 3 records the returned vibrations or oscillations in the medium 1, which arise at the particular location at which the receiving transducer 3 is secured. The returned vibrations, for example, may have the form illustrated in FIG. 3*c*. The returned vibrations will be a modulated signal in which the frequency variations, modulated on the carrier, as illustrated in FIG. 3*b*, is subjected to a predetermined time delay. Thus, the modulation envelope, as illustrated in FIG. 3*d*, is time-shifted with respect to the modulation envelope of FIG. 3*a*. This time delay, or time shift, corresponds to the transit time of vibrations between transmitter 2 and receiver 3, if the oscillations are simple sine waves, determined by the propagation velocity of the medium, as well as by the geometric distance between transmitter and receiver. By suitable choice of carrier frequency, shift frequency (that is, the frequency of the wave illustrated in FIG. 3*a*) and the extent of frequency variation, that is, the range of frequency change, the time difference can be substantially multiplied. It is believed that the reason therefor is found in the phenomenon referred to as group velocity delay effect, which is known from wave theory. A modulated signal which is transmitted by a transmitting medium which has resonance characteristics, such as a narrow band filter, will be subjected to a time delay, the extent of which will depend on the width of the resonance frequency and the Fourier frequency spectrum of the modulated electrical wave with respect thereto. The time delay is a phase, or group velocity delay. It has been found that mechanical sonic-type oscillations also exhibit the same effect, when sonic-type vibrations are transmitted by a sonically, or acoustically transmissive medium having inherent resonance frequencies within the range of the carrier frequency. The entire glass panel 1 (FIG. 1) will act as a resonator in the example described. Particularly if higher frequencies are selected, permitting a large number of degrees of liberty, a plurality of resonance points or resonance frequencies will be found to occur.

Figure 1:
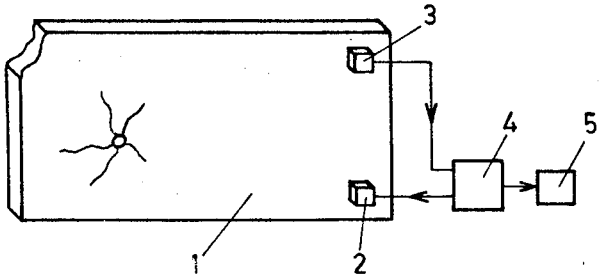
FIG. 1 is a highly schematic illustration of the system applied to protect a glass display panel.

Even minor damage of the glass panel, for example breaking off of a piece at the edge, cutting at a side, or boring therethrough will cause such a shift in the various resonance points that the apparent delay time between transmitter 2 and receiver 3 will change substantially. The damage to the glass panel need be only within the approximate order of magnitude of the wave length of the vibrations induced in the glass panel. It is almost irrelevant at which position on the glass panel the transmitter and the receiver are located, relative to the damage to which the panel is subjected. Thus, as illustrated in FIG. 1, receiver and transmitter may be located at an edge; breaking off of a remote corner at the opposite side — that is, not at all between the transmitter and the receiver — will result in substantial shift or relocation of the resonance points which, in turn, results in the aforementioned time shifts in the modulated signal received at the receiver. Thus, the entire medium is supervised, independently of the exact positioning of transmitter and receiver, and the location of any fault or disturbance in the medium with respect to the receiver and the transmitter, or a geometric line drawn therebetween. Likewise, perforating or rupturing the panel at any location therein will cause substantial change and shift in the resonance points.

Mere touching of the panel does not change the time shift. Thus, wetting of the panel, for example by rain, does not lead to a shift of the inherent resonance points; it only leads to an amplitude attenuation. The temporal shift in the received signal, with respect to the transmitted signal, that is, the shift of the received signal relative to the transmitted signal with respect to time; remains unchanged. Thus, touching or even hitting the glass panel without damaging the panel as such will not result in generation of an alarm if the time shift of the received signal with respect to the transmitted signal is utilized solely as the monitoring characteristic. No false alarm will be generated by touching, impinging on the glass, or coating the glass, for example by rain, impingement of hail stones, or the like, provided that the panel itself is not damaged.

The transmitter need not be matched to any specific resonance point on the panel, since the system and method are independent of amplitude. It is sufficient if inherent resonance points in the panel are available in the approximate vicinity of the carrier frequency.

The received signals are transduced from sonic to electrical signals by transducer 3 which, preferably, is a piezo-electric crystal. The electrical signal is connected to an electrical circuit 8, 9. Element 8, connected to the piezo-electric crystal is an amplifier which selectively amplifies the received signals and applies the amplified signal to a frequency demodulator 9, so that the output of the frequency demodulator 9 will have only the modulation signal appear thereat. The circuits 8, 9 may, for example, be a phase-locked loop, as schematically indicated in FIG. 2. Such a phase-locked loop is, effectively, a self-tuning filter and will adjust itself, automatically, on the received carrier frequency. It amplifies the signal having this frequency, and frequencies therearound, automatically, to a predetermined value and simultaneously provides the demodulation signal thus, effectively, also acting as frequency demodulator 9, so that the output from unit 9 will be the signal shown at FIG. 3*d*.

The signal of FIG. 3*d* is compared with the signal of FIG. 3*a*, for example in a coincidence or AND-gate 10, having its inputs connected to units 6, and 9, respectively. The comparison available at the output of the AND-gate 9 will only be positive when there is coincidence between both signals. Since the signals of the frequency demodulator 9 are time-shifted with respect to the modulator 6, however, a periodic square wave will be received from gate 10, as illustrated in FIG. 3*e*. The signal from AND-gate 10 is applied to an integrator 11, to form an average value. The output signals from integrator 11, that is, the average value, is applied to an alarm device which provides an alarm signal when the average value changes by a predetermined amount in either direction, that is, reaches an upper, or lower threshold value schematically illustrated as $S_1$ and $S_2$ in FIG. 3*e*. Averaging the output from the AND-gate 10, with respect to time, in effect provides a measure of the width of the overlap (or, put in other words, the degree of coincidence, or of non-coincidence) and hence provides a measure of the time shift in transmission between transmitter transducer 2 and receiving transducer 3. The threshold circuit determining the upper and lower level of the output from integrator 11 may, for example, be a dual comparator, comparing the output with upper and lower reference values; or, for example, a dual Schmitt trigger. Compensation may be provided to eliminate the effect of slow drift, for example due to temperature variations. Drift can be compensated by including in the output circuit a differentiator which provides an alarm only when the average value changes at a predetermined rate, that is, if the average value in a predetermined interval changes by a predetermined value, so that the rate of change of average value is sensed. This system eliminates the necessity for a closed control loop which controls the frequency shift of unit 6, as well as the carrier frequency of generator 7, and which adjusts the respective frequencies to prevent drift. The system does not require accurate adjustment of the frequency with respect to any predetermined resonance frequencies, or resonance points; the phase-locked loop circuit automatically adjusts itself to the carrier frequency — which may drift — and thus the system is substantially immune to noise and disturbances, as well as to false alarms. Complicated stabilization and synchronization systems and circuits can, therefore, be avoided, particularly if rate of change of integrated time delay is sensed. Such a differentiator and rate-of-change circuit are well known and may be included within the alarm circuit 5.

Rather than using an AND-gate 10 and an integrator 11, various other circuits providing similar output effects may be used. For example, gate 10 and integrator 11 may be combined in a coincidence discriminator. The output signal at such a coincidence discriminator depends on the time difference of the two input signals applied thereto, that is, the signals from units 6 and 9 and applied to AND-gate 10. Other, similarly functioning or connected gates may be used, such as a NAND-gate, or a difference forming circuit, or a voltage comparator. Such comparator circuits may, for example, be constructed in the form of operational amplifiers, in which the respective inputs are connected to the outputs of unit 6, and 9, respectively; or by a group of operational amplifiers in which one input is connected to a respective reference, and the other input has the output from either unit 6, or unit 9, respectively, applied thereto to form, simultaneously, a threshold sensing circuit as well as a comparison circuit with respect to a reference. By including capacitors in the feedback circuit of the operational amplifier, suitable integrating, or differentiating functions of input with respect to output signals can be obtained.

The invention is applicable not only to supervise panels, walls, panes, or the like, but may also be used to supervise any medium capable of conducting sonic-type waves, such as objects, or spaces, such as rooms, safes, or sonically conductive strips, such as enclosures, fences, or the like. If a room is to be supervised, the medium 1 is formed by the air within the room. The frequency radiated into the room to set the air into vibration should be suitably selected to match the medium to provide a plurality of resonance points; in case of air in a room, a lower frequency than that for glass panels should be selected.

The system and method permit evaluation of transmitted sonic-type waves by comparison of these waves with received vibrations. If there is an operational breakdown in the circuit or system at any point therein, the signal applied to the comparison circuit formed by AND-gate 10 will change from the standard signal, and an alarm will be provided. Thus, the monitoring system is essentially fail-safe.

The invention has been described in connection with a frequency-modulated signal. Other types of modulation may be used; thus, the signal may be phase-modulated, continuously frequency-modulated, or pulse-modulated as shown; amplitude modulation is also possible, and the circuit must then be so modified that it permits an evaluation of the time shift of the modulated signal.

More than one sonically conductive object or spaces may be supervised from a single central monitoring station. Referring to FIG. 4: A plurality of sonically conductive objects $G_1$, $G_2$, $G_3$, $G_4$ are monitored from a central station C. The modulated ultrasonic signal is first applied to a transmitter transducer S1. An ultrasonic receiver E1 senses the vibrations within the object $G_1$; the transducer E1 is then connected to the transmitter S2 on the second object $G_2$, the received wave therefrom is connected from receiving transducer E2 to transmitting transducer S3 on object $G_3$; the wave received is connected by receiving transducer E3 to transmitting transducer S4 on object $G_4$. The receiving transducer E4 is connected back to the central station C. Other units may be interposed in similar manner. At each transmission of wave or vibratory energy through one of the objects, a time delay will arise in the ultrasonic signal. The various time delays or time shifts will add; the overall time shift or time delay is then transmitted back to the central station C. If in any one of the objects to be supervised, damage or interruption or change in the time shift will result, the overall time shift of the signal applied to the central station C, with respect to the transmitted signal will change, permitting evaluation of the changed signal, for example generating an alarm. A similar system has previously been proposed with an ultrasonic monitoring and supervisory system in which the various independent objects $G_1....G_4$ are subjected to vibrations which result in resonance therein, and an amplitude attenuation of any one of the protected devices was utilized to generate an alarm. Such a system required that all the objects are brought to resonant vibrations since, otherwise, the transmitting path would be interrupted. It was, therefore, possible only to supervise objects having the same size and the same composition and type, so that they had the same resonant points and frequencies. This is extremely difficult to find in actual practice. The system of the present invention is completely independent of amplitudes and exact matching of the transmitted frequencies to resonance points, or resonant frequencies is not necessary. The objects $G_1...G_4$ (or, for that matter, $G_n$, in which $n$ is any number) may be different, and may have entirely different resonance spectra, may be of different size, shape and materials. A single control station, or control central may, however, be used to monitor the serially connected transmitting and receiving transducers applied to the various objects. By checking or testing for transmission delay time between transmitter and receiver, and utilizing time or phase shifts or delays of received signal with respect to transmitted signal, a large number of objects of various types, sizes and shapes can be monitored from a single control central station.

Various changes and modifications may be made within the scope of the inventive concept, and features described in connection with any embodiment, or characteristic may, similarly, be used in other embodiments of the invention.

I claim:

1. Method of monitoring conduction of sonic-type waves in an acoustically conductive medium, in which wave-type signals are generated; the generated wave-type signals are applied to the medium at a transmitting location by a transmitter applying sonic-type signals to the medium; the transmitted sonic-type signals are received from the medium by a receiver at a receiving location; and an alarm signal is generated when a predetermined change in a characteristic of said generated signal with respect to said received signals is detected; comprising the steps of:

generating a sonic-type carrier wave;

frequency-modulating said carrier wave to provide frequency-modulated sonic-type signals;

sensing the shift, with respect to time, of the modulation of the received wave with respect to the modulation of the transmitted signals, said time, or temporal shift defining said characteristics of the signal;

determining change in said time, or temporal shift of the received modulation signal with respect to the generated modulation signal to evaluate change in the group velocity of the waves in the medium;

and generating said alarm signal when the change in temporal shift of the modulation between transmitted and received signals exceeds a predetermined value.

2. Method according to claim 1, wherein the step of generating the sonic-type signals comprises the step of generating sonic-type signals of substantially sine wave form.

3. Method according to claim 1, wherein the step of generating the frequency modulated Sonic-type signals comprises the step of generating sonic-type signals of cyclically, alternatingly different frequency.

4. Method according to claim 3, wherein the step of sensing the temporal shift of the modulation of the signals between the generated and received signals comprises sensing the temporal shift of the frequency alternations between transmitted and received signals.

5. Method according to claim 4, wherein the step of generating an alarm signal comprises the step of generating said alarm signal when the temporal shift of the frequency alternations varies by a predetermined value from a fixed value.

6. Method according to claim 4, wherein the step of determining change in the temporal shift comprises the step of determining the rate of change of the temporal shift of the cyclically alternating frequencies, and the step of generating the alarm signal comprises the step of generating said alarm signal when the rate of change of said shift exceeds a predetermined value.

7. Method according to claim 1, wherein the step of generating signals comprises the step of generating signals in the order of between 120 kHz to 180 kHz.

8. System according to claim 1, wherein the sonically conductive medium is a metal wall.

9. Method according to claim 1, to supervise a medium shaped to define a side, in which the transmitting location and the receiving location are at the same side of the medium.

10. Method according to claim 1, wherein the frequency of the frequency modulation is in the order of about 100 Hz.

11. Method according to claim 1, to supervise a medium having a predetermined geometric shape, wherein the carrier frequency is matched to the geometric shape of the medium to have one or more resonance points within the medium.

12. System to monitor conduction of sonic waves in an acoustically conductive medium, comprising means (7) generating signals of a sonic, or ultrasonic frequency;

frequency modulating means (6) connected to said signal generator means (7) to provide frequency-modulated signals;

transmitter transducer means (2) located at a transmitting location and transmitting the generated frequency-modulated signals to the medium to be supervised to introduce frequency-modulated sonic-type vibrations in said medium;

receiver transducer means (3) located at a receiving location receiving vibrations from said medium transmitted therein by said transmitter transducer means (2) and providing an electrical received signal;

frequency demodulator means connected to the receiving transducer means (37);

time detector means (10, 11) connected to both said generator means (7) and said receiving transducer means (3) and determining the relative temporal change between the modulation, and demodulation envelope of the transmitted, and received waves, respectively, to evaluate change in the group velocity of the waves in the medium;

and alarm generating means to provide an alarm when the temporal relationship of the modulation between transmitted and received signals as determined by the time detector means (10, 11) changes beyond a predetermined level.

13. System according to claim 12, further comprising a phase-locked loop circuit connected between the receiving transducer means (3) and the time detector means (10, 11).

14. System according to claim 12, wherein the time detector means comprises a coincidence gate (10) connected, repectively, to the transmitter means and to the receiving transducer means, the output from the coincidence gate being a predetermined signal representative of the difference between the signals connected thereto.

15. System according to claim 14, wherein the time detector means further comprises an averaging circuit connected to the output of the coincidence gate.

16. System according to claim 15, wherein the coincidence gate (10) and the averaging circuit means (11) comprises a coincidence discriminator, providing an output representative of the time difference of the input signals applied to the coincidence gate.

17. System according to claim 15, wherein the alarm generating means comprides a circuit connected to provide an alarm signal when the average value derived from the averaging circuit changes by a predetermined level from a fixed reference level.

18. System according to claim 15, wherein the alarm generating means comprises a circuit which includes a differentiating circuit responsive to rate of change of the averaged value derived from the averaging circuit means, and providing an output alarm signal when the rate of change of the averaged value of the signal from the coincidence gate changes over a predetermined limit.

19. System according to claim 12, wherein the frequency-modulating means comprises pulse-type frequency shift control means (6) connected to change the frequency of the generator means (7), is cyclically alternating, repetitive step about a central carrier value.

20. System according to claim 19, wherein the carrier wave value of the wave generated by the generator means (7) is in the order of about 150 kHz, and ±30 kHz; and the frequency modulation, in cyclically alternating steps, modulates the carrier wave frequency by a value in the order of about ± 100 Hz.

21. System according to claim 12, wherein the sonically conductive medium is a glass panel.

22. System according to claim 12, wherein the sonically conductive medium is a panel having a side, and wherein said transmitter transducer means (2) and the receiver transducer means (3) are located at the same side of the panel.

23. System according to claim 12, for simultaneous monitoring of a plurality of sonically conductive objects, or media, characterized by a plurality of transmitting transducer means (S1, S2, S3, S4); a plurality of receiving transducer means (E1, E2, E3, E4); each one of the objects ($G_1$, $G_2$, $G_3$, $G_4$) having a respective transmitting and receiving transducer in sonically transmitting relation thereto, to transmit sonic-type frequency-modulated waves into the objects and receive sonic-type frequency-modulated waves, after transmission by the object, in the receiving transducer, said respective transmitting and receiving transducers being serially connected, from one receiving transducer to the next transmitting transducer, of the objects, the first and last transmitting and receiving transducers, respectively, being connected to the generating means (7) and the time detector means, respectively.

24. System according to claim 12, wherein the medium has a predetermined geometric shape;

and wherein the frequency generating means generate a signal having a carrier falling within the region of the resonance frequencies of the medium.

25. Method of monitoring conduction of sonic-type wave in an acoustically conductive medium, in which wave-type signals are generated; the generated wave-type signals are applied to the medium at a transmitting location by a transmitter applying sonic-type signals to the medium; the transmitted sonic-type signals are received from the medium by a receiver at a receiving location; and an alarm signal is generated when a predetermined change in the characteristic of said generated signal with respect to said received signal is detected;

comprising the steps of:

generating at least two sonic-type waves of slightly different frequency;

applying said waves to the medium so that said waves will propagate in the medium and generate interferences to obtain propagation of the waves in the medium subject to the group velocity phenomenon;

receiving said at least two waves;

analyzing the interference wave or waves resulting from interference of the at least two waves due to the group velocity phenomenon;

and determining change in the interference wave to obtain an indication of disturbance of, or in the medium.

26. Method according to claim 25, wherein the step of generating said waves comprises generating a carrier wave;

frequency-shifting the carrier wave between two closely adjacent frequencies and applying said frequency-shifted waves to the medium.

27. Method according to claim 25, wherein the frequency difference between said at least two waves is about ± 100 Hz.

28. System to monitor conduction of sonic waves in an acoustically conductive medium having dispersion comprising means (7) generating at least two signals of a sonic or ultrasonic frequency, the at least two signals being of slightly different frequency;

transmitter-transducer means (2) located at the transmitting location and transmitting said generated waves to the medium to be supervised in the form of sonic-type signals propagating in the medium, to obtain propagation of the waves therein subject to the group velocity phenomenon;

receiver transducer means (3) located at a receiving location receiving vibrations from said medium transmitted therein by said transmitter-transducer means and providing an electrical received signal;

demodulator means connected to the receiver transducer means and demodulating the received signal;

time detector means (10, 11) connected to both said generator means (7) and said receiver transducer means and determining relative temporal change of the demodulated signal to evaulate change in the group velocity of the waves in the medium;

and circuit means providing an output signal when the temporal relationship of said at least two transmitted waves and said received signal, as determined by said time detector means, changes beyond a predetermined level.

29. System according to claim 28, wherein said signal generating means comprises means generating signals having a frequency difference of about ±100 Hz.

30. System according to claim 28, wherein the medium has a predetermined geometric shape;

and wherein the signal generating means generates signals having frequencies falling within the region of the resonance frequencies of the medium.

* * * * *